US009072369B1

(12) United States Patent
Shokoohi

(10) Patent No.: US 9,072,369 B1
(45) Date of Patent: Jul. 7, 2015

(54) ORAL CARE IMPLEMENT

(71) Applicant: Cyrus Shokoohi, Marietta, GA (US)

(72) Inventor: Cyrus Shokoohi, Marietta, GA (US)

( * ) Notice: Subject to any disclaimer, the term of this patent is extended or adjusted under 35 U.S.C. 154(b) by 0 days.

(21) Appl. No.: 14/583,576

(22) Filed: Dec. 26, 2014

(51) Int. Cl.

| | |
|---|---|
| ***A46B 9/04*** | (2006.01) |
| ***A46B 15/00*** | (2006.01) |
| ***A46D 3/00*** | (2006.01) |
| *A46B 17/06* | (2006.01) |

(52) U.S. Cl.
CPC . *A46B 9/04* (2013.01); *A46B 15/00* (2013.01); *A46D 3/00* (2013.01); *A46B 17/06* (2013.01)

(58) Field of Classification Search
CPC ..... A46B 9/04; A46B 17/06
USPC ..... 15/167.1
See application file for complete search history.

(56) References Cited

U.S. PATENT DOCUMENTS

| | | | | |
|---|---|---|---|---|
| 4,638,521 | A * | 1/1987 | Potente et al. | 15/117 |
| 5,802,656 | A * | 9/1998 | Dawson et al. | 15/110 |
| 5,836,036 | A * | 11/1998 | Ivory | 15/167.1 |
| 7,503,092 | B2 * | 3/2009 | Russell | 15/167.1 |
| 8,046,864 | B2 * | 11/2011 | Baertschi et al. | 15/167.1 |

* cited by examiner

*Primary Examiner* — Laura C Guidotti
(74) *Attorney, Agent, or Firm* — Matthew Zarghouni; Fomby & Zarhhouni LLC

(57) ABSTRACT

The present invention relates to an oral care implement comprising a head and a handle, the head having a first surface and a second surface; the head having a plurality of cleaning members coupled to the first surface; the head having a plurality of openings defined therein, wherein each opening of the plurality of openings passing through the first surface and second surface provide for the drainage of the fluids and the air ventilation; and wherein the plurality of cleaning members arranged adjacent to the plurality of openings without blocking the openings thereby forming a plurality of ventilation channels among the plurality of cleaning members.

17 Claims, 4 Drawing Sheets

ORAL CARE IMPLEMENT

FIELD OF THE INVENTION

Figure 1:
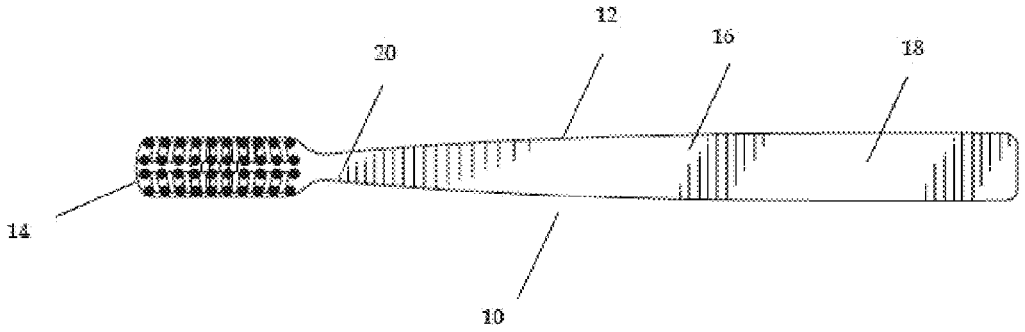

The present invention relates to the field of oral care implements (e.g., toothbrushes) and designs, and more particularly to such designs that provide effective drainage of water, toothpaste and food residues, and debris that tend to be left behind on the oral care implement after each oral cleaning event, while providing air a ventilation mechanism for effective drying of the oral care implement.

BACKGROUND OF THE INVENTION

The oral care implements, such as toothbrush, are used on a daily basis to clean the oral cavity, and hence is a very important piece of equipment known for proper dental hygiene. Any toothbrush plays an important role for personal oral hygiene and effective plaque removal. Oral cavity incubates diversity of microorganisms; therefore it is not surprising that some of these microorganisms were transferred to toothbrush during use. Furthermore, toothbrushes are most commonly located near the bathroom sink, which is a good place to harvest hundreds of microorganisms. No matter how hygienic the bathroom is, the toothbrush will still be consistently exposed to the mouth, which will inevitably result in bacterial growth on the toothbrush.

In particular, the head of a toothbrush traps moisture and food debris. That is because the blocked bottom of the toothbrush head and the bristles of the toothbrush do not allow the fluid and food particles to easily escape the head. This leaves the toothbrush head to be a favorable media for microbial organisms for growth.

Although toothbrushes have been around for many years, the toothbrush head structures have not changed much. All modifications made to the toothbrush heads are related to either their aesthetic design or their movement mechanism. However, none of these modifications is to the basic structure of the toothbrush head to allow for proper drainage and ventilation of the toothbrush head.

Having known this problem, a goal of this invention is to minimize the propagation of microbial presence on a toothbrush head by providing a means for sanitizing and ensuring the toothbrush head remains clean. As stated above, the conventional toothbrush due to its inherent design cannot address this issue. Therefore, a need exists for an improved toothbrush head that provides a mechanism for effectively removing moisture and food particles from the toothbrush.

SUMMARY OF THE INVENTION

The present invention relates to an oral care implement comprising a head and a handle, the head having a first surface and a second surface; the head having a plurality of cleaning members coupled to the first surface; the head having a plurality of openings defined therein, wherein each opening of the plurality of openings passing through the first surface and second surface provide for the drainage of fluids and air ventilation; and wherein the plurality of cleaning members arranged adjacent to the plurality openings without blocking the openings thereby form a plurality of ventilation channels among the plurality of cleaning members.

Further, an embodiment of the present invention relates to an oral care implement comprising a head and a handle, wherein the head member having a transversely reduced neck portion adjacent one end to merge into the handle; the head having a first surface and a second surface; the head having a plurality of cleaning members coupled to the first surface; the head having a plurality of openings defined therein, wherein each opening of the plurality of openings passing through the first surface and second surface to provide for drainage of fluids and air ventilation; wherein the plurality of cleaning members arranged adjacent the plurality openings without blocking the openings, thereby forming a plurality of ventilation channels among the plurality of cleaning members; and wherein the first surface having side surfaces, wherein the surface sides are defined by walls converging downwardly from periphery of the first surface toward the plurality of openings.

In operation, drainage of fluids and air ventilation in an oral care implement can be done by coupling a head to a handle, wherein the head having a first surface and a second surface; include a plurality of cleaning members on the first surface; defining a plurality of openings among the plurality of cleaning members; wherein each opening of the plurality of openings extends between the first surface and the second surface; and arranging the plurality of cleaning members arranged adjacent the plurality openings without blocking the openings, thereby forming a plurality of ventilation channels among the plurality of cleaning members for allowing the fluid or air to pass through the head. Further, this task may include providing for the drainage of fluids and include at least a groove on the first surface for directing fluids into the plurality of openings that in turn direct the fluids to the plurality of openings.

DETAIL DESCRIPTION OF THE DRAWINGS

The following drawings illustrates exemplary embodiments; however, they are helpful in illustrating objects, features, and advantages of the present invention, because the present invention will be more apparent from the following detailed description taken in conjunction with the accompanying drawings, in which:

FIG. 1 is a top view of an embodiment of a dental care implement.

Figure 1A:
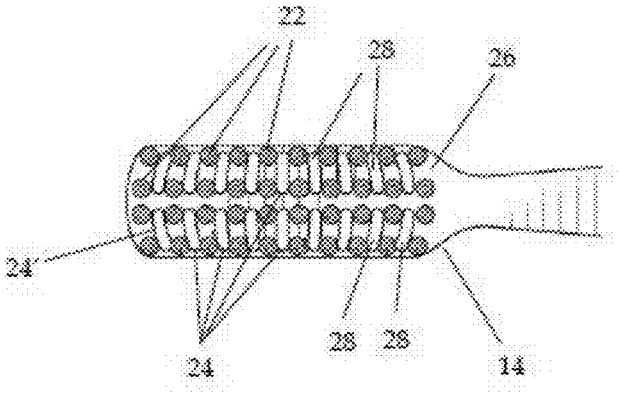

FIG. 1*a* is a top view of the head of the dental care implement of FIG. 1.

Figure 1B:
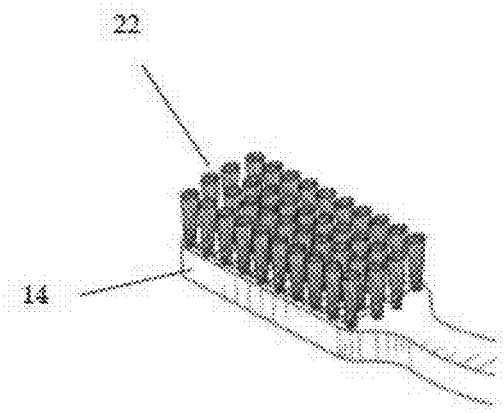

FIG. 1*b* is a perspective view of the head of the dental care implement of FIG. 1.

Figure 2:
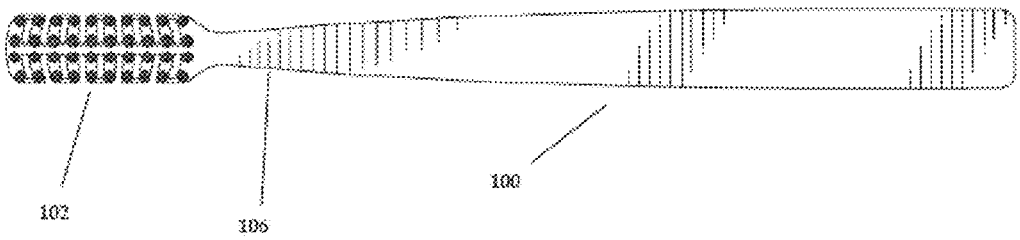

FIG. 2 is a top view of an embodiment of a dental care implement.

Figure 2A:
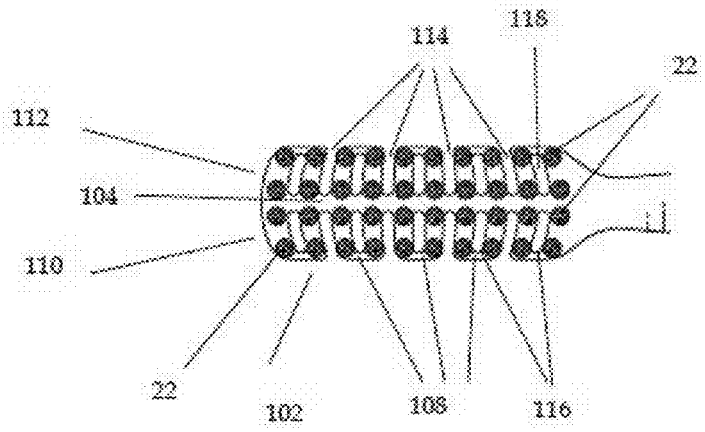

FIG. 2*a* is a top view of the head of the dental care implement of FIG. 2.

Figure 3:
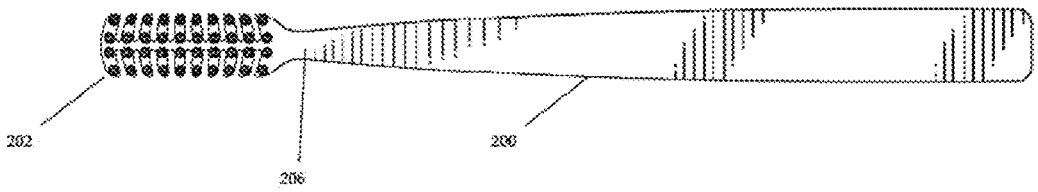

FIG. 3 is a top view of an embodiment of a dental care implement.

Figure 3A:
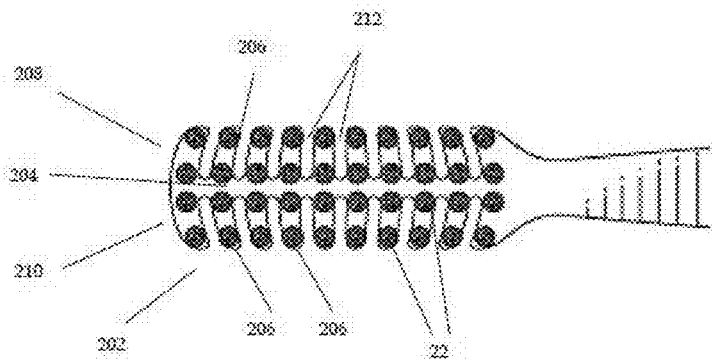

FIG. 3*a* is a top view of the head of the dental care implement of FIG. 3.

DETAIL DESCRIPTION OF THE INVENTION

FIG. 1 shows an improved oral care implement 10. Here, the improved oral care implement 10 ("implement") is a toothbrush. The implement 10 includes a body 12. The body 12 may be made by injection molding of a plastic material, paper, fiberglass, elastomers, polypropylene, SAN, ABS, or it may be made of wood, or a combination aforementioned materials. The body 12 is a longitudinal body including a head 14 and handle 16.

The handle 16 includes a shaft like handle 18 and a neck section 20. The handle 16 may be a formation of many different three-dimensional shapes including but not limited to cylindrical, cuboid, etc. While the head 14 is normally widened relative to a neck section 20 of the shaft like handle 18, it could in some constructions simply be a continuous extension or narrowing of the handle 16. The head 14 may be a manual head or an electric head for oscillation or rotation of the cleaning members, driven by a motor.

As shown in the FIGS. 1*a*-1*b*, the head 14 joins the shaft like handle 18 from the neck section 20. The head 14 includes a plurality of cleaning members 22. The cleaning members 22 may consist of tightly clustered bristles mounted on the head 14, which facilitates the cleansing of the surface of the teeth and hard-to-reach areas of the oral cavity. The cleaning members 22 may be made of plastic or other materials appropriate for cleaning the surface of the teeth. The cleaning members 22 may be configured in various sizes, dimensions, geometry, and placement in relation to the head 14. In the present embodiment, the head 14 may include various bristle textures, sizes and forms. In the present embodiment, cleaning members 22 are made of nylon and the body 12 is molded from thermoplastic materials.

The head 14 include a plurality of openings 24. The plurality of openings 24 are distributed on the head 14 such that each opening 24' is an opening that extends through the first surface 26 and the second surface (not shown) on the opposing side of the first surface 26. The plurality of openings 24 are arranged for allowing the drainage after each brushing event. In the present embodiment, the plurality of openings 24 consists of openings that are shaped alike. For example, the plurality of openings 24 may have circular, oval, triangular, rectangular, etc. shapes. In some embodiments, the openings 24 may consist of differently shaped openings. The plurality of openings 24 in the present embodiment, have a length larger than their width. In terms of the size of each opening, the openings 24 are sized so that surface tension from the intermolecular forces of attraction in a fluid is defeated and can facilitate the drainage from the.

The cleaning members 22 surround each opening 24' without interfering with the plurality of openings 24. In other words, the cleaning members 22 in relation to the plurality of openings 24 form a plurality of channels 28 extending from the distal end 28 of the cleaning members 22 through the head 14. The plurality of channels 28 allow for proper ventilation among the cleaning members 22.

Furthermore, at least one groove (not shown) is configured on the first surface 26 for leading fluids into the plurality of openings 24. The groove(s) allows the fluid to properly flow from the bottom of the head of the toothbrush into the plurality of openings 24. The plurality of openings also facilitate rinsing by allowing fluid to pass through the head 14 from either surfaces (e.g., first and second surfaces) of the head 14. In some embodiments; however, the toothbrush head comprises angled steep surfaces for leading fluids into the plurality of openings. The first surface 26 having side surfaces, wherein the surface sides are defined by surfaces (not shown) converging downwardly from periphery of the first surface toward the plurality of openings. For example, the first surface 26 may be a "v" shaped surface for providing a steep surface to aid fluid flow into the plurality of the openings 24.

In operation, drainage of fluids and air ventilation in the oral care implement 10 can be done by including a plurality of cleaning members 22 on the first surface 26 of the head 14 and by defining a plurality of openings 26 among the plurality of cleaning members 22; wherein each opening of the plurality of openings 24 extends between the first surface 26 and the second surface. Furthermore, the drainage and ventilation may be done by arranging the plurality of cleaning members 22 arranged adjacent the plurality openings 24 without blocking the plurality of openings 24, thereby forming a plurality of ventilation channels 28 among the plurality of cleaning members 22 for allowing fluid or air to pass through the head 14. Further, this task may include providing for the drainage of fluids and including at least a groove (not shown) on the first surface 26 for directing fluid into the plurality of openings 22.

FIGS. 2-2*a* show another embodiment of the implement 100. In this embodiment, the head 102 includes a support arm 104. The support arm 104 may be an extension of the neck section 106. The support arm 104 may be slightly thinner than the neck section 106. Here, the support arm 104 includes a plurality of loops 108 arranged on opposing sides 110, 112 of the support arm 104. The loops 108 on each side of the support arm 104 may be placed with a predetermined distance (e.g., 0.5-3 mm) from one another; so the gaps 114 are formed between the adjacent loop members 108. The plurality of gaps form indentations on the periphery of the head 102.

In this embodiment, the head 102 includes the cleaning members 22. The cleaning members 22 extend from the loop members 104; however, they do not interfere with the openings 116 of the loops 108. In each loop, the cleaning members 22 and the opening 116 of each loop form a channel extending through the brush head. The channels 118 and gaps 114 allow proper drainage and ventilation.

FIGS. 3-3*a* show another embodiment of the implement 200. In this embodiment, the head 202 includes a support arm 204. The support arm 204 includes a plurality of fingers 206 on its opposing sides 208, 210. The gaps 212 are formed between two adjacent fingers 206 on each side of the support arm. Furthermore, the fingers 206 are symmetrically arranged about the support arm 204. In some embodiments however, the fingers 206 are arranged asymmetrically about the support arm 204. Each FIG. 206 includes cleaning members 22. The cleaning members 22 arranged so they do not interfere with the gaps 212. The gaps 212 allow for fluid drainage of the implement 202, and air ventilation in the head 202.

It is noted that the embodiments of the oral care implement described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The invention claimed is:

1. An oral care implement comprising:

a head and a handle, the head having a first surface and a second surface;

the head having a plurality of cleaning members coupled to the first surface;

the head having a plurality of openings defined therein, wherein each opening of the plurality of openings passing through the first surface and second surface for providing for drainage of fluid and air ventilation;

wherein each opening of the plurality of opening is sized for allowing fluid to drain from the first surface; wherein the plurality of cleaning members arranged adjacent the plurality openings without blocking the openings thereby forming a plurality of ventilation channels among the plurality of cleaning members; and at least one groove defined on the first surface for directing fluid to the plurality of openings.

2. The oral care implement of claim 1 wherein the head comprises a support member wherein a plurality of loops are coupled to opposing sides of the support member.

3. The oral care implement of claim 2 wherein each loop of the plurality of loops having an opening defined therein for providing for drainage of fluid and air ventilation.

4. The oral care implement of claim 1, wherein the plurality of openings forming indentations on the periphery of the head.

5. The oral care implement of claim 1, wherein each opening of plurality of openings having a shape substantially similar to an adjacent opening.

6. The oral care implement of claim 1, wherein the plurality of openings comprising of openings with different shapes.

7. The oral care implement of claim 1, wherein the plurality of cleaning members is comprising of at least two clusters, wherein each cluster having a shape.

8. The oral implement of claim 7, wherein each opening of the plurality of openings having a length larger than its width.

9. An oral care implement comprising:

a head and a handle, wherein the head member having a transversely reduced neck portion adjacent one end to merge into the handle;

the head having a first surface and a second surface;

the head having a plurality of cleaning members coupled to the first surface;

the head having a plurality of openings defined therein, wherein each opening of the plurality of openings passing through the first surface and second surface for providing for drainage of fluid and air ventilation;

wherein the plurality of cleaning members arranged adjacent the plurality openings without blocking the openings, thereby forming a plurality of ventilation channels among the plurality of cleaning members;

wherein the first surface having side surfaces, wherein the surface sides are defined by walls converging downwardly from periphery of the first surface toward the plurality of openings; and wherein at least on groove defined on the first surface for directing fluid to the plurality of openings.

10. The oral care implement of claim 9 wherein the head comprises a support member wherein a plurality of loops are coupled to opposing sides of the support member.

11. The oral care implement of claim 10 wherein each loop of the plurality of loops having an opening defined therein for providing for drainage of fluid and air ventilation.

12. The oral care implement of claim 9, wherein a plurality of gaps forming indentations on the periphery of the head.

13. The oral care implement of claim 9, wherein each opening of plurality of openings having a shape substantially similar to an adjacent opening.

14. The oral care implement of claim 9, wherein the plurality of openings comprising of openings with different shapes.

15. The oral implement of claim 14, wherein each opening of the plurality of openings having a length larger than its width.

16. The oral care implement of claim 9, wherein the plurality of cleaning members is comprising of at least two clusters, wherein each cluster having a shape.

17. The method of providing for drainage of fluid and air ventilation in an oral care implement comprising:

coupling a head to a handle, wherein the head having a first surface and a second surface;

including a plurality of cleaning members on the first surface;

defining a plurality of openings among the plurality of cleaning members; wherein each opening of the plurality of openings extends between the first surface and the second surface; and arranging the plurality of cleaning members arranged adjacent the plurality openings without blocking the plurality of openings, thereby forming a plurality of ventilation channels among the plurality of cleaning members for allowing fluid or air to pass through the head; and at least a groove on the first surface for directing fluid into the plurality of openings.

* * * * *